US006932672B2

(12) United States Patent
Elledge

(10) Patent No.: US 6,932,672 B2
(45) Date of Patent: Aug. 23, 2005

(54) APPARATUS FOR IN-SITU OPTICAL ENDPOINTING ON WEB-FORMAT PLANARIZING MACHINES IN MECHANICAL OR CHEMICAL-MECHANICAL PLANARIZATION OF MICROELECTRONIC-DEVICE SUBSTRATE ASSEMBLIES AND METHODS FOR MAKING AND USING SAME

(75) Inventor: Jason B. Elledge, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 721 days.

(21) Appl. No.: 09/833,029

(22) Filed: Apr. 10, 2001

(65) Prior Publication Data

US 2001/0044261 A1 Nov. 22, 2001

Related U.S. Application Data

(63) Continuation of application No. 09/300,358, filed on Apr. 26, 1999, now Pat. No. 6,213,845.

(51) Int. Cl.[7] ..... B24B 49/00

(52) U.S. Cl. ..... 451/6; 451/285; 451/299

(58) Field of Search ..... 451/5, 6, 8, 9, 451/41, 60, 285–290, 299, 300, 301, 306, 921; 342/450, 451, 453, 457, 463; 455/456.1, 456.2, 456.6

(56) References Cited

U.S. PATENT DOCUMENTS 5,337,144 A 8/1994 Strul et al. ..... 356/357
5,413,941 A 5/1995 Koos et al. ..... 438/16
5,433,651 A 7/1995 Lustig et al. ..... 451/6
5,439,551 A 8/1995 Meikle et al. ..... 438/5
5,643,050 A 7/1997 Chen ..... 451/10
5,648,847 A 7/1997 Ebbing ..... 356/150
5,667,424 A 9/1997 Pan ..... 451/6
5,700,180 A 12/1997 Sandhu et al. ..... 451/5

(Continued)

*Primary Examiner*—Lee D. Wilson
*Assistant Examiner*—Anthony Ojini
(74) *Attorney, Agent, or Firm*—Dorsey & Whitney LLP

(57) ABSTRACT

Polishing pads, planarizing machines and methods for mechanical and/or chemical-mechanical planarization of microelectronic-device substrate assemblies. The polishing pads, for example, can be web-format pads, and the planarizing machines can be web-format machines. In a typical application, the web-format machines have a pad advancing mechanism and stationary table with a first dimension extending along a pad travel path, a second dimension transverse to the first dimension, and an illumination site from which a laser beam can emanate from the table. The pad advancing mechanism moves the pad along the pad travel path to replace worn portions of the pad with fresh portions. In one embodiment of the invention, a web-format polishing pad includes a planarizing medium and an optical pass-through system having a plurality of view sites through which a light beam can pass through the pad. The planarizing medium can have a planarizing surface configured to engage the substrate assembly and a backside to face towards the table. The view sites of the optical pass-through system extend along the pad in a direction generally parallel to the pad travel path so that a view site is aligned with the illumination site on the table as the pad moves across the table.

20 Claims, 9 Drawing Sheets

U.S. PATENT DOCUMENTS

| | | | | |
|---|---|---|---|---|
| 5,730,642 | A | 3/1998 | Sandhu et al. | 451/6 |
| 5,834,375 | A | 11/1998 | Chen | 438/692 |
| 5,851,135 | A | 12/1998 | Sandhu et al. | 451/5 |
| 5,872,633 | A | 2/1999 | Holzapfel et al. | 356/630 |
| 5,934,974 | A | 8/1999 | Tzeng | 451/6 |
| 5,948,203 | A | 9/1999 | Wang | 156/345.03 |
| 5,997,384 | A | 12/1999 | Blalock | 451/41 |
| 6,000,996 | A | 12/1999 | Fujiwara | 451/6 |
| 6,045,439 | A | 4/2000 | Birang et al. | 451/526 |
| 6,074,517 | A | 6/2000 | Taravade | 156/345.13 |
| 6,108,091 | A | 8/2000 | Pecen et al. | 356/381 |
| 6,121,147 | A | 9/2000 | Daniel et al. | 438/692 |
| 6,179,709 | B1 | 1/2001 | Redeker et al. | 457/6 |
| 6,241,847 | B1 | 6/2001 | Allman et al. | 438/8 |
| 6,254,459 | B1 * | 7/2001 | Bajaj et al. | 451/41 |
| 6,285,035 | B1 | 9/2001 | Taravade | 250/559.22 |
| 6,323,046 | B1 | 11/2001 | Agarwal | 438/8 |
| 6,426,232 | B1 | 7/2002 | Litvak | 438/8 |
| 6,454,630 | B1 * | 9/2002 | Tolles | 451/6 |
| 6,458,014 | B1 * | 10/2002 | Ihsikawa et al. | 451/6 |
| 6,607,422 | B1 * | 8/2003 | Swedek et al. | 451/6 |
| 6,612,901 | B1 * | 9/2003 | Agarwal | 451/6 |

* cited by examiner

APPARATUS FOR IN-SITU OPTICAL ENDPOINTING ON WEB-FORMAT PLANARIZING MACHINES IN MECHANICAL OR CHEMICAL-MECHANICAL PLANARIZATION OF MICROELECTRONIC-DEVICE SUBSTRATE ASSEMBLIES AND METHODS FOR MAKING AND USING SAME

CROSS-REFERENCE TO RELATED APPLICATION

This application is a continuation of U.S. patent application Ser. No. 09/300,358, filed Apr. 26, 1999 now U.S. Pat. No. 6,213,845.

TECHNICAL FIELD

The present invention relates to devices for endpointing mechanical and/or chemical-mechanical planarizing processes of microelectronic-device substrate assemblies and, more particularly, to web-format polishing pads and planarizing machines for in-situ optical endpointing.

BACKGROUND OF THE INVENTION

Mechanical and chemical-mechanical planarizing processes (collectively "CMP") are used in the manufacturing of electronic devices for forming a flat surface on semiconductor wafers, field emission displays and many other microelectronic-device substrate assemblies. CMP processes generally remove material from a substrate assembly to create a highly planar surface at a precise elevation in the layers of material on the substrate assembly.

FIG. 1 is a schematic isometric view of a web-format planarizing machine 10 that has a table 11 with a support surface 13. The support surface 13 is generally a rigid panel or plate attached to the table 11 to provide a flat, solid workstation for supporting a portion of a web-format planarizing pad 40 in a planarizing zone "A" during planarization. The planarizing machine 10 also has a pad advancing mechanism including a plurality of rollers to guide, position, and hold the web-format pad 40 over the support surface 13. The pad advancing mechanism generally includes a supply roller 20, first and second idler rollers 21*a* and 21*b*, first and second guide rollers 22*a* and 22*b*, and a take-up roller 23. As explained below, a motor (not shown) drives the take-up roller 23 to advance the pad 40 across the support surface 13 along a travel axis T—T. The motor can also drive the supply roller 20. The first idler roller 21*a* and the first guide roller 22*a* press an operative portion of the pad against the support surface 13 to hold the pad 40 stationary during operation.

The planarizing machine 10 also has a carrier assembly 30 to translate a substrate assembly 12 across the pad 40. In one embodiment, the carrier assembly 30 has a head 32 to pick up, hold and release the substrate assembly 12 at appropriate stages of the planarizing process. The carrier assembly 30 also has a support gantry 34 and a drive assembly 35 that can move along the gantry 34. The drive assembly 35 has an actuator 36, a drive shaft 37 coupled to the actuator 36, and an arm 38 projecting from the drive shaft 37. The arm 38 carries the head 32 via another shaft 39. The actuator 36 orbits the head 32 about an axis B—B to move the substrate assembly 12 across the pad 40.

The polishing pad 40 may be a non-abrasive polymeric web (e.g., a polyurethane sheet), or it may be a fixed abrasive polishing pad having abrasive particles fixedly dispersed in a resin or some other type of suspension medium. During planarization of the substrate assembly 12, a planarizing fluid 44 flows from a plurality of nozzles 45. The planarizing fluid 44 may be a conventional CMP slurry with abrasive particles and chemicals that etch and/or oxidize the substrate assembly 12, or the planarizing fluid 44 may be a "clean" non-abrasive planarizing solution without abrasive particles. In most CMP applications, abrasive slurries are used on non-abrasive polishing pads, and clean solutions are used on fixed abrasive polishing pads.

In the operation of the planarizing machine 10, the pad 40 moves across the support surface 13 along the pad travel path T—T either during or between planarizing cycles to change the particular portion of the polishing pad 40 in the planarizing zone A. For example, the supply and take-up rollers 20 and 23 can drive the polishing pad 40 between planarizing cycles such that a point P moves incrementally across the support surface 13 to a number of intermediate locations $I_1$, $I_2$, etc. Alternatively, the rollers 20 and 23 may drive the polishing pad 40 between planarizing cycles such that the point P moves all the way across the support surface 13 to completely remove a used portion of the pad 40 from the planarizing zone A. The rollers may also continuously drive the polishing pad 40 at a slow rate during a planarizing cycle such that the point P moves continuously across the support surface 13. Thus, the polishing pad 40 should be free to move axially over the length of the support surface 13 along the pad travel path T—T.

CMP processes should consistently and accurately produce a uniform, planar surface on substrate assemblies to enable circuit and device patterns to be formed with photolithography techniques. As the density of integrated circuits increases, it is often necessary to accurately focus the critical dimensions of the photo-patterns to within a tolerance of approximately 0.1 $\mu$m. Focusing photo-patterns to such small tolerances, however, is difficult when the planarized surfaces of substrate assemblies are not uniformly planar. Thus, to be effective, CMP processes should create highly uniform, planar surfaces on substrate assemblies.

In the highly competitive semiconductor industry, it is also desirable to maximize the throughput of CMP processing by producing a planar surface on a substrate assembly as quickly as possible. The throughput of CMP processing is a function of several factors, one of which is the ability to accurately stop CMP processing at a desired endpoint. In a typical CMP process, the desired endpoint is reached when the surface of the substrate assembly is planar and/or when enough material has been removed from the substrate assembly to form discrete components on the substrate assembly (e.g., shallow trench isolation areas, contacts, damascene lines, etc.). Accurately stopping CMP processing at a desired endpoint is important for maintaining a high throughput because the substrate assembly may need to be re-polished if it is "under-planarized." Accurately stopping CMP processing at the desired endpoint is also important because too much material can be removed from the substrate assembly, and thus it may be "over-polished." For example, over-polishing can cause "dishing" in shallow-trench isolation structures or completely destroy a section of the substrate assembly. Thus, it is highly desirable to stop CMP processing at the desired endpoint.

In one conventional method for determining the endpoint of CMP processing, the planarizing period of a particular substrate assembly is estimated using an estimated polishing rate based upon the polishing rate of identical substrate assemblies that were planarized under the same conditions. The estimated planarizing period for a particular substrate assembly, however, may not be accurate because the polishing rate may change from one substrate assembly to another. Thus, this method may not produce accurate results.

In another method for determining the endpoint of CMP processing, the substrate assembly is removed from the pad and then a measuring device measures a change in thickness of the substrate assembly. Removing the substrate assembly from the pad, however, interrupts the planarizing process and may damage the substrate assembly. Thus, this method generally reduces the throughput of CMP processing.

U.S. Pat. No. 5,433,651 issued to Lustig et al. ("Lustig") discloses an in-situ chemical-mechanical polishing machine for monitoring the polishing process during a planarizing cycle. The polishing machine has a rotatable polishing table including a window embedded in the table. A polishing pad is attached to the table, and the pad has an aperture aligned with the window embedded in the table. The window is positioned at a location over which the workpiece can pass for in-situ viewing of a polishing surface of the workpiece from beneath the polishing table. The planarizing machine also includes a reflectance measurement means coupled to the window on the underside of the rotatable polishing table for providing a reflectance signal representative of an in-situ reflectance of the polishing surface of the workpiece.

Although the apparatus disclosed in Lustig is an improvement over other CMP endpointing techniques, it cannot work in web-format planarizing applications because web-format planarizing machines have stationary support tables over which web-format polishing pads move either during or between planarizing cycles. For example, if the polishing pad in Lustig was used on a web-format machine that advances the pad over a stationary table, the single circular aperture in Lustig's polishing pad would become misaligned with a window in the stationary table. The polishing pad disclosed in Lustig would then block a light beam from a reflectance or interferrometric endpointing device under the stationary table. As such, the in-situ endpointing apparatus disclosed in Lustig would not work with web-format planarizing machines.

SUMMARY OF THE INVENTION

The present invention is directed toward polishing pads, planarizing machines and methods for mechanical and/or chemical-mechanical planarization of microelectronic-device substrate assemblies. The polishing pads and the planarizing machines, for example, can be web-format type devices. In a typical application, the web-format machines have a pad advancing mechanism and stationary table with a first dimension extending along a pad travel path, a second dimension transverse to the first dimension, and an illumination site from which a laser beam can emanate from the table. The pad advancing mechanism moves the pad along the pad travel path to replace a worn portion of the pad with a fresh portion. In one embodiment of the invention, a web-format polishing pad includes a planarizing medium and an optical pass-through system having a plurality of view sites through which a light beam can pass through the pad. The planarizing medium can have a planarizing surface configured to engage the substrate assembly and a backside to face towards the table. The view sites of the optical pass-through system extend along the pad in a direction generally parallel to the pad travel path so that a view site can be aligned with the illumination site on the table as the pad moves across the table.

In one particular embodiment of the invention, the polishing pad further includes an optically transmissive backing sheet under the planarizing medium and a backing pad under the backing sheet. For example, the planarizing medium can be disposed on a top surface of the backing sheet and the backing pad can be attached to an under surface of the backing sheet. The optical pass-through system can include an elongated slot or a plurality of discrete openings through both the planarizing medium and the backing pad that extend in a line along the length of the pad in the direction generally parallel to the pad travel path. The view sites are accordingly locations along the elongated slots or the discrete openings through which a laser can pass to detect the end point of a substrate assembly in-situ and during the planarizing cycle.

DETAILED DESCRIPTION OF THE INVENTION

The present invention is directed toward polishing pads, planarizing machines, and methods for endpointing mechanical and/or chemical-mechanical planarizing processes of microelectronic-device substrate assemblies. Many specific details of the invention are described below with reference to web-format planarizing applications to provide a thorough understanding of such embodiments. The present invention, however, may be practiced in other applications, such as using individual polishing pads that are approximately the same size as a platen or table. Thus, one skilled in the art will understand that the present invention may have additional embodiments, or that the invention may be practiced without several of the details described in the following description.

Figure 2:
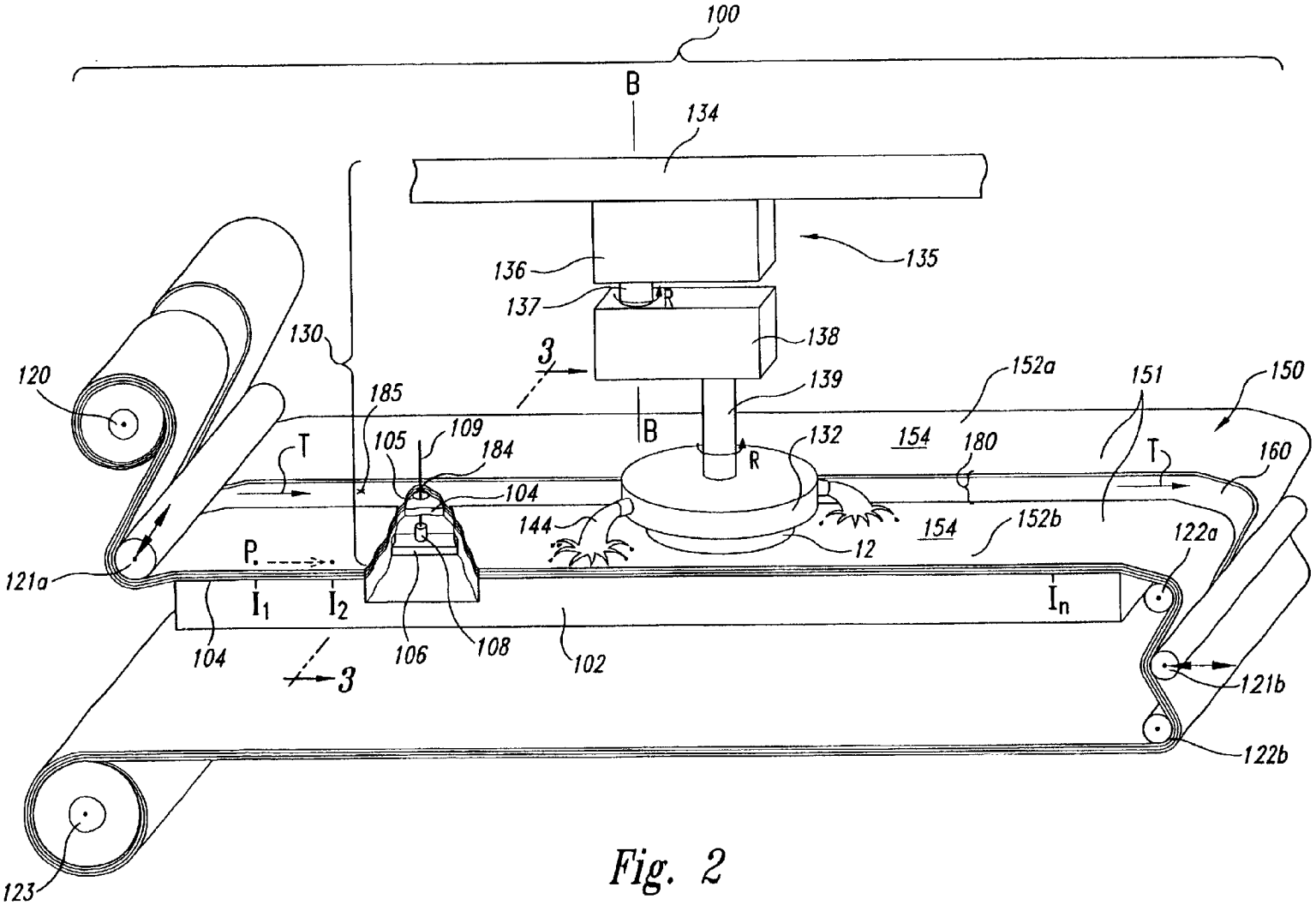
FIG. 2 is an isometric view with a cut-away portion of a web-format planarizing machine and a web-format polishing pad in accordance with one embodiment of the invention.

FIG. 2 is an isometric view of a web-format planarizing machine 100 with a polishing pad 150 in accordance with an embodiment of the invention. The planarizing machine 100 has a table 102 including a stationary support surface 104, an opening 105 at an illumination site in the support surface 104, and a shelf 106 under the support surface 104. The planarizing machine 100 also includes an optical endpoint sensor 108 mounted to the shelf 106 at the illumination site.

The optical endpoint sensor 108 projects a light beam 109 through the hole 105 and the support surface 104. The optical endpoint sensor 108 can be a reflectance device or an interferrometer that emits the light beam 109 and senses a return beam (not shown) to determine the surface condition of a substrate assembly 12 in-situ and in real time. Reflectance and interferometer endpoint sensors that may be suitable for the optical sensor 108 are disclosed in U.S. Pat. Nos. 5,648,847; 5,337,144; 5,777,739; 5,663,797; 5,465,154; 5,461,007; 5,433,651; 5,413,941; 5,369,488; 5,324,381; 5,220,405; 4,717,255; 4,660,980; 4,640,002; 4,422,764; 4,377,028; 5,081,796; 4,367,044; 4,358,338; 4,203,799; 4,200,395; and U.S. application Ser. No. 09/066,044, all of which are herein incorporated by reference. Another suitable optical endpoint sensor is used in the Mirra® CMP system manufactured by Applied Materials of California.

Figure 1:
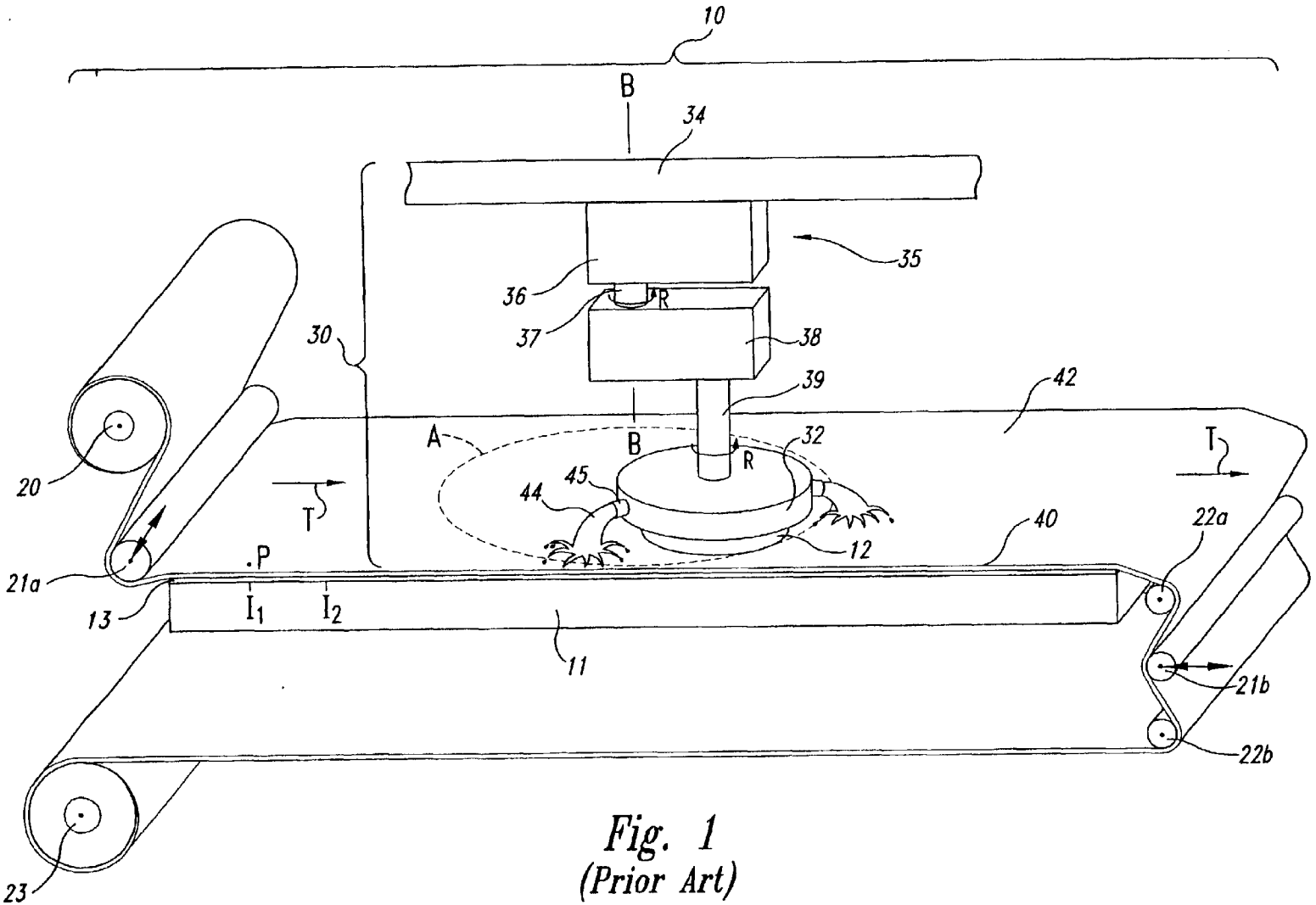
Fig. 1 (Prior Art)
FIG. 1 is an isometric view of a web-format planarizing machine in accordance with the prior art.

The planarizing machine 100 can further include a pad advancing mechanism having a plurality of rollers 120, 121*a*, 121*b*, 122*a*, 122*b* and 123 that are substantially the same as the roller system described above with reference to the planarizing machine 10 in FIG. 1. Additionally, the planarizing machine 100 can include a carrier assembly 130 that is substantially the same as the carrier assembly 30 described above with reference to FIG. 1.

Figure 3:
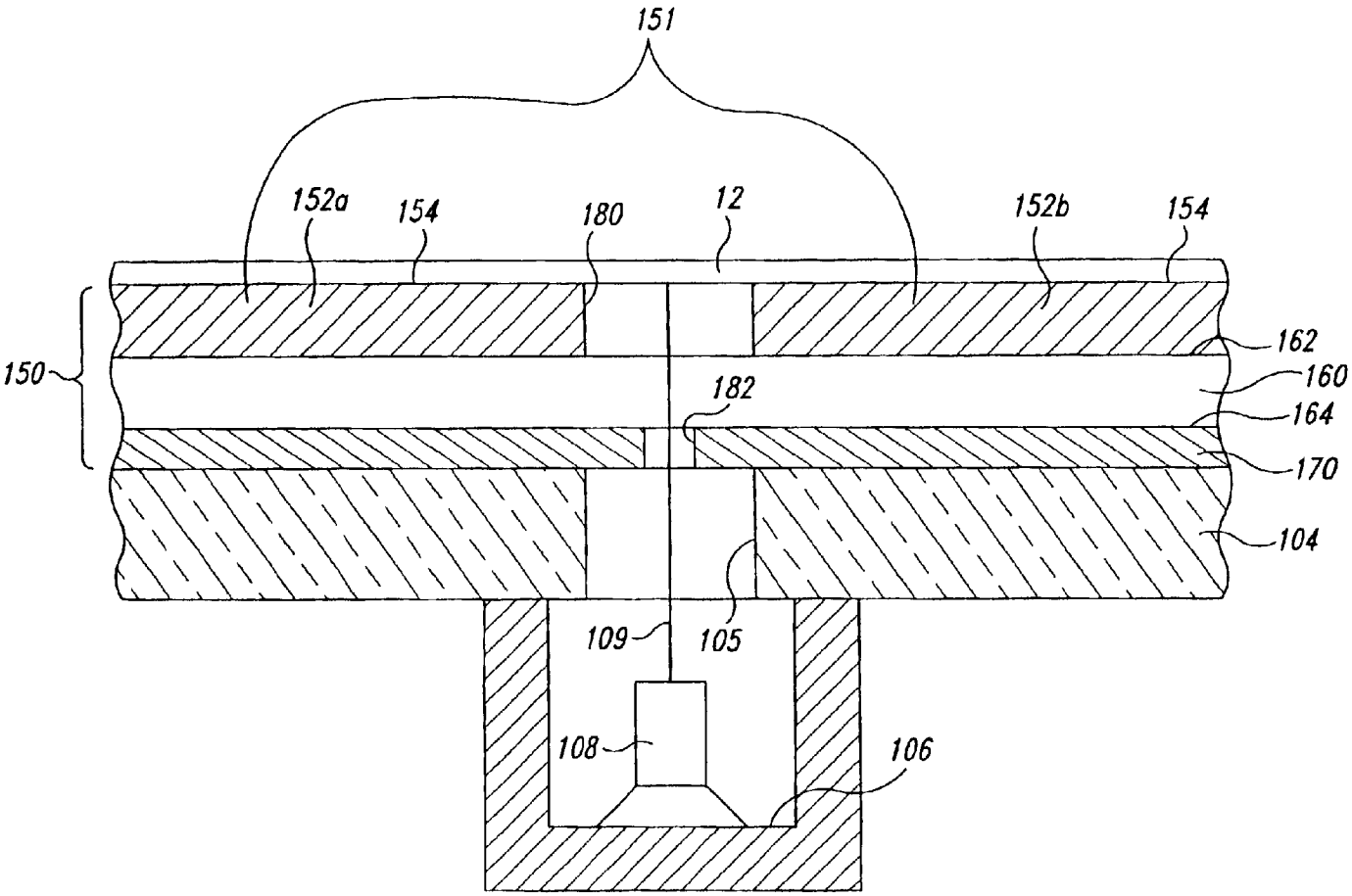
FIG. 3 is a cross-sectional view of the polishing pad of FIG. 2 taken along line 3—3.

FIG. 3 is a cross-sectional view partially illustrating the polishing pad 150, the support surface 104, and the optical endpoint sensor 108. Referring to FIGS. 2 and 3 together, the polishing pad 150 has a planarizing medium 151 with a first section 152*a*, a second section 152*b*, and a planarizing surface 154 defined by the upper surfaces of the first and second sections 152*a* and 152*b*. The planarizing medium 151 can be an abrasive or a non-abrasive material. For example, an abrasive planarizing medium 151 can have a resin binder and abrasive particles distributed in the resin binder. Suitable abrasive planarizing mediums 151 are disclosed in U.S. Pat. Nos. 5,645,471; 5,879,222; 5,624,303; and U.S. patent application Ser. Nos. 09/164,916 and 09/001,333, all of which are herein incorporated by reference. In this embodiment, the polishing pad 150 also includes an optically transmissive backing sheet 160 under the planarizing medium 151 and a resilient backing pad 170 under the backing sheet 160. The planarizing medium 151 can be disposed on a top surface 162 of the backing sheet 160, and the backing pad 170 can be attached to an under surface 164 of the backing sheet 160. The backing sheet 160, for example, can be a continuous sheet of polyester (e.g., Mylar®) or polycarbonate (e.g., Lexan®). The backing pad 170 can be a polyurethane or other type of compressible material. In one particular embodiment, the planarizing medium 151 is an abrasive material having abrasive particles, the backing sheet 160 is a long continuous sheet of Mylar, and the backing pad 170 is a compressible polyurethane foam.

The polishing pad 150 also has an optical pass-through system to allow the light beam 109 to pass through the pad 150 and illuminate an area on the bottom face of the substrate assembly 12 irrespective of whether a point P on the pad 150 is at intermediate position $I_1$, $I_2$ . . . or $I_n$ (FIG. 2). In this embodiment, the optical pass-through system includes a first view port defined by a first elongated slot 180 through the planarizing medium 151 and a second view port defined by a second elongated slot 182 (FIG. 3 only) through the backing pad 170. The first and second elongated slots 180 and 182 can extend along the length of the polishing pad 150 in a direction generally parallel to a pad travel path T—T. The first and second slots 180 and 182 are also aligned with the hole 105 in the support surface 104 so that the light beam 109 can pass through any view site along the first and second slots 180 and 182. For the purposes of this embodiment, a view site of the optical pass-through system is any location along the first and second elongated slots 180 and 182 positioned over the hole 105. For example, when the point P is at intermediate location $I_1$, a view site 184 along the first and second elongated slots 180 and 182 is aligned with the hole 105. After the polishing pad 150 has moved along the pad travel path T—T so that the point P is at intermediate position $I_2$, another view site 185 along the first and second elongated slots 180 and 182 is aligned with the hole 105.

The embodiment of the polishing pad 150 shown in FIGS. 2 and 3 allows the optical endpointing sensor 108 to detect the surface condition of the substrate assembly 12 in-situ and in real time during a planarizing cycle on the web-format planarizing machine 100. In operation, the carrier assembly 130 moves the polishing pad 12 across the planarizing surface 154 as a planarizing solution 144 flows on to the polishing pad 150. The planarizing solution 144 is generally a clear, non-abrasive solution that does not block the light beam 109 from passing through the first elongated slot 180. As the carrier assembly 130 moves the substrate assembly 12, the light beam 109 passes through the optically transmissive backing sheet 160 and the clean planarizing solution in the first elongated slot 180 to illuminate the face of the substrate assembly 12 (FIG. 3). The optical endpoint sensor 108 thus periodically detects the surface condition of the substrate assembly 12 throughout the planarizing cycle. The optical endpoint sensor 108 can also indicate when the surface condition corresponds to the desired endpoint of the planarizing process. The substrate assembly 12 is then removed from the polishing pad 150 and another substrate assembly is loaded into the head 132 for planarization. The rollers 120 and 123 also incrementally advance the polishing pad 150 along the pad travel path T—T to move the point P from one intermediate position to another. The view site along the first and second elongated slots 180 and 182 accordingly changes to allow the light beam 109 to pass through another portion of the optical pass-through system of the polishing pad 150. The carrier assembly 130 then moves the second substrate assembly over the planarizing surface 154 and the illumination site to planarize the second substrate assembly. The polishing pad 150 accordingly allows the light beam 109 to pass through any portion of the polishing pad 150 positioned over the illumination site as the polishing pad 150 moves with respect to the table 102.

Figure 4:
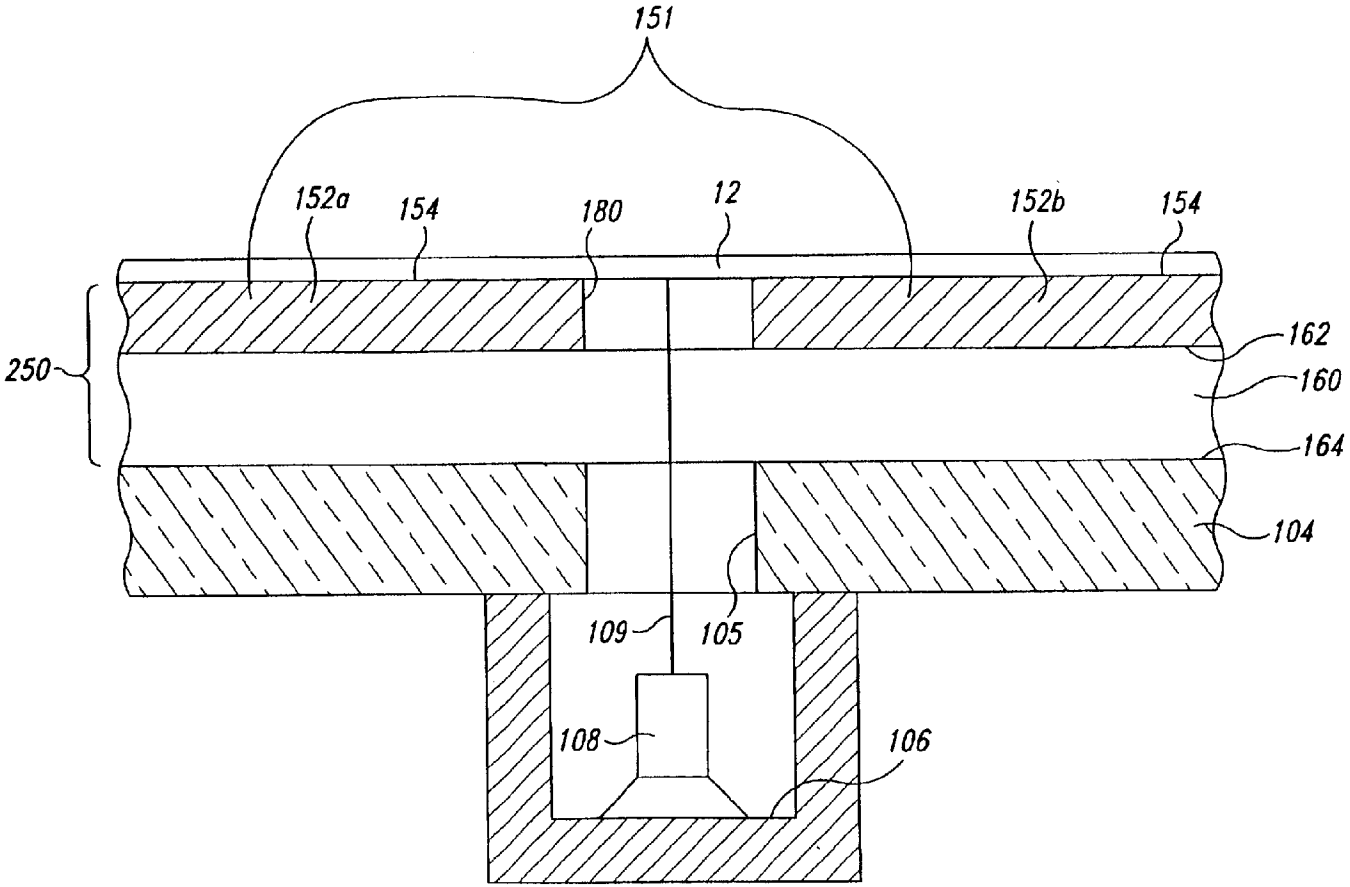
FIG. 4 is a cross-sectional view of a web-format polishing pad in accordance with another embodiment of the invention.

FIGS. 4 is a cross-sectional view of a polishing pad 250 in accordance with another embodiment of the invention. The polishing pad 250 has the planarizing medium 151 disposed on the top surface 162 of the optically transmissive backing sheet 160, but the polishing pad 250 does not have a backing pad 170 attached to the backing sheet 160. The optical pass-through system of this embodiment includes the optically transmissive backing sheet 160 and the first elongated slot 180.

Figure 5:
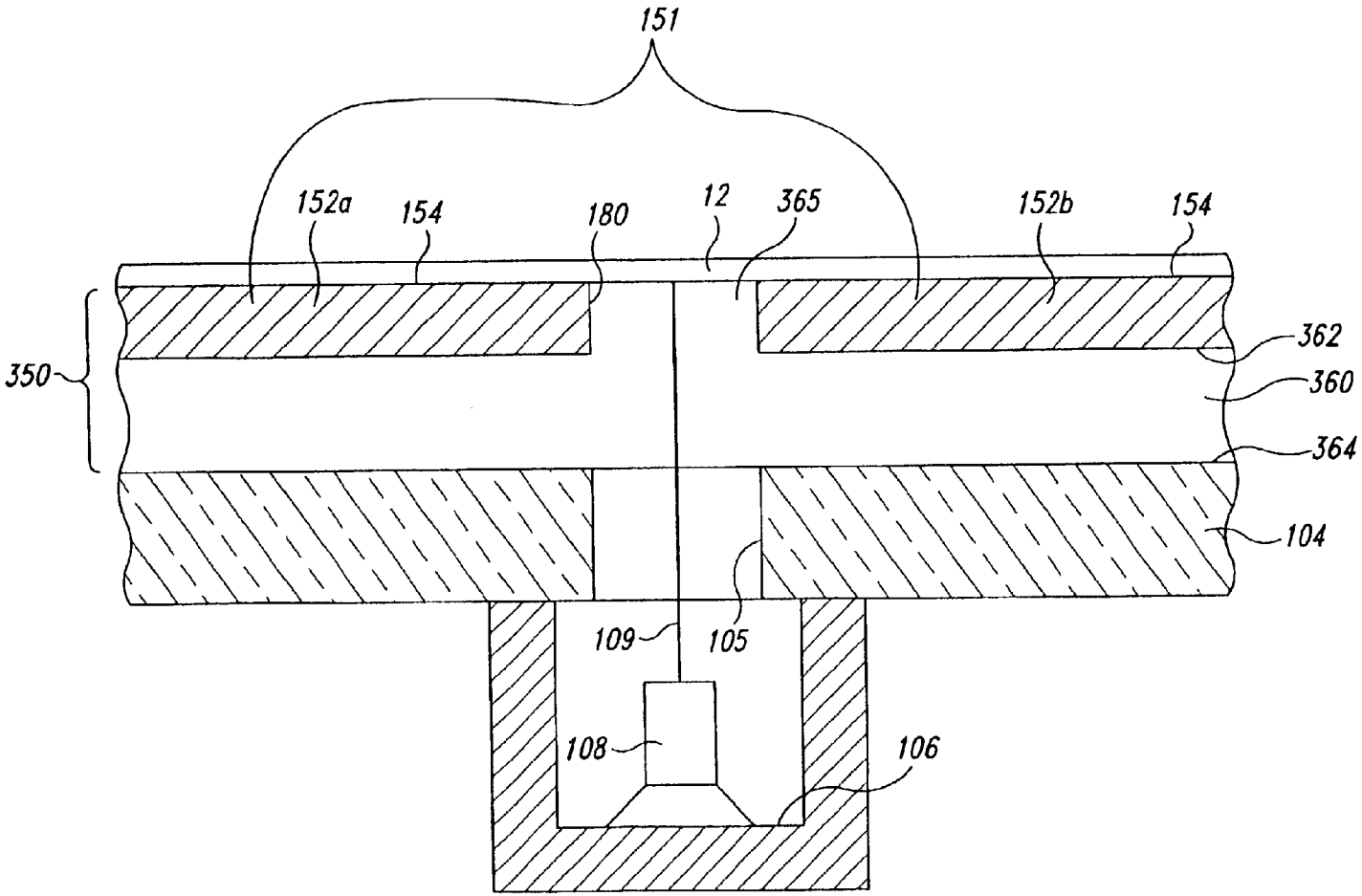
FIG. 5 is a cross-sectional view of a web-format polishing pad in accordance with yet another embodiment of the invention.

FIG. 5 is a cross-sectional view of a polishing pad 350 in accordance with still another embodiment of the invention. The polishing pad 350 has the planarizing medium 151 disposed on a top surface 362 of a backing sheet 360. The polishing pad 350 differs from the polishing pad 250 shown in FIG. 4 in that the backing sheet 360 of the polishing pad 350 also includes a flat-topped ridge 365 projecting upwardly into the elongated slot 180 between the first and second sections 152*a* and 152*b* of the planarizing medium 151. The polishing pad 250 illustrated in FIG. 4 is expected to be particularly effective for use with clean planarizing solutions because these solutions do not block the light beam 109 from passing through the elongated slot 180 during planarization. The polishing pad 350 shown in FIG. 5 is expected to be particularly effective for use with abrasive or otherwise opaque planarizing solutions because the ridge 365 on the optically transmissive backing sheet 360 maintains an optically transmissive path from the face of the substrate 12 to the optical endpoint sensor 108.

Figure 6:
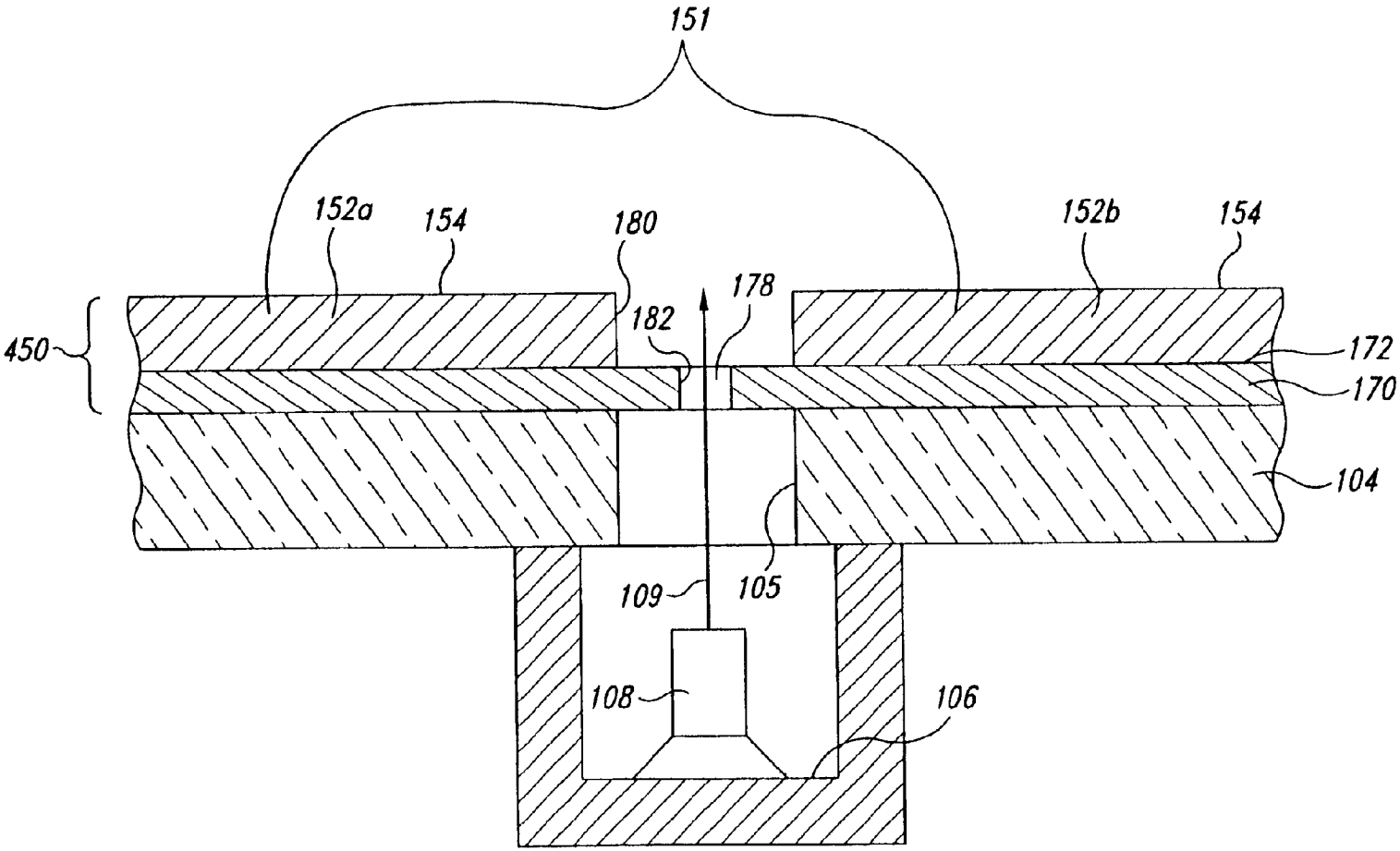
FIG. 6 is a cross-sectional view of a web-format polishing pad in accordance with still another embodiment of the invention.

FIG. 6 is a cross-sectional view illustrating another polishing pad 450 in accordance with yet another embodiment of the invention. The polishing pad 450 includes the planarizing medium 151 and the compressible backing pad 170, but it does not include an optically transmissive backing sheet 160. In this embodiment, the first and second sections 152*a* and 152*b* of the planarizing medium are disposed on a first surface 172 of the backing pad 170. The optical pass-through system of this embodiment, therefore, includes the first elongated slot 180 through the polishing medium 151 and the second elongated slot 182 through the backing pad 170. In this particular embodiment, the backing pad 170 may also include an optically transmissive insert 178 in the second elongated slot 182 to prevent the planarizing solution 144 (FIG. 2) from dripping onto the optical endpoint sensor 108.

Figure 7:
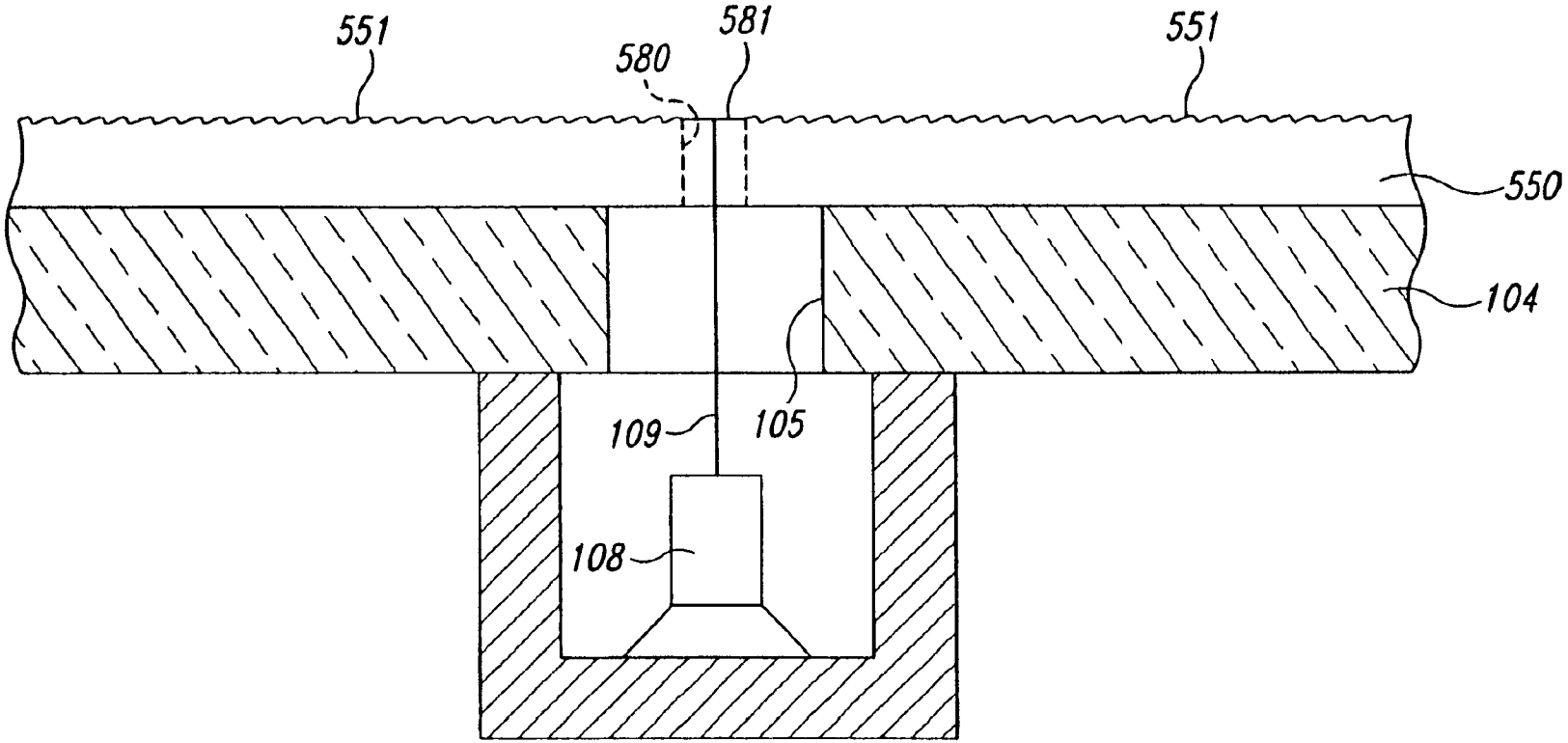
FIG. 7 is a cross-sectional view of a web-format polishing pad in accordance with an additional embodiment of the invention.

FIG. 7 is a cross-sectional view of a polishing pad 550 in accordance with still another embodiment of the invention. The polishing pad 550 is an optically transmissive pad having a planarizing medium 551 and a flat surface 581. The pad 550, for example, can be a hard polyester (e.g., Mylar) or a hard polycarbonate (e.g., Lexan), and the planarizing medium 551 can be a roughened surface on the polyester or polycarbonate. The optical pass-through system in defined by the flat surface 581 and the portion of the pad 550 under the flat surface 581. In one particular embodiment, the flat surface 581 is an elongated surface extending generally parallel to the pad travel path T—T (FIG. 2) along the length of the pad.

Figure 8:
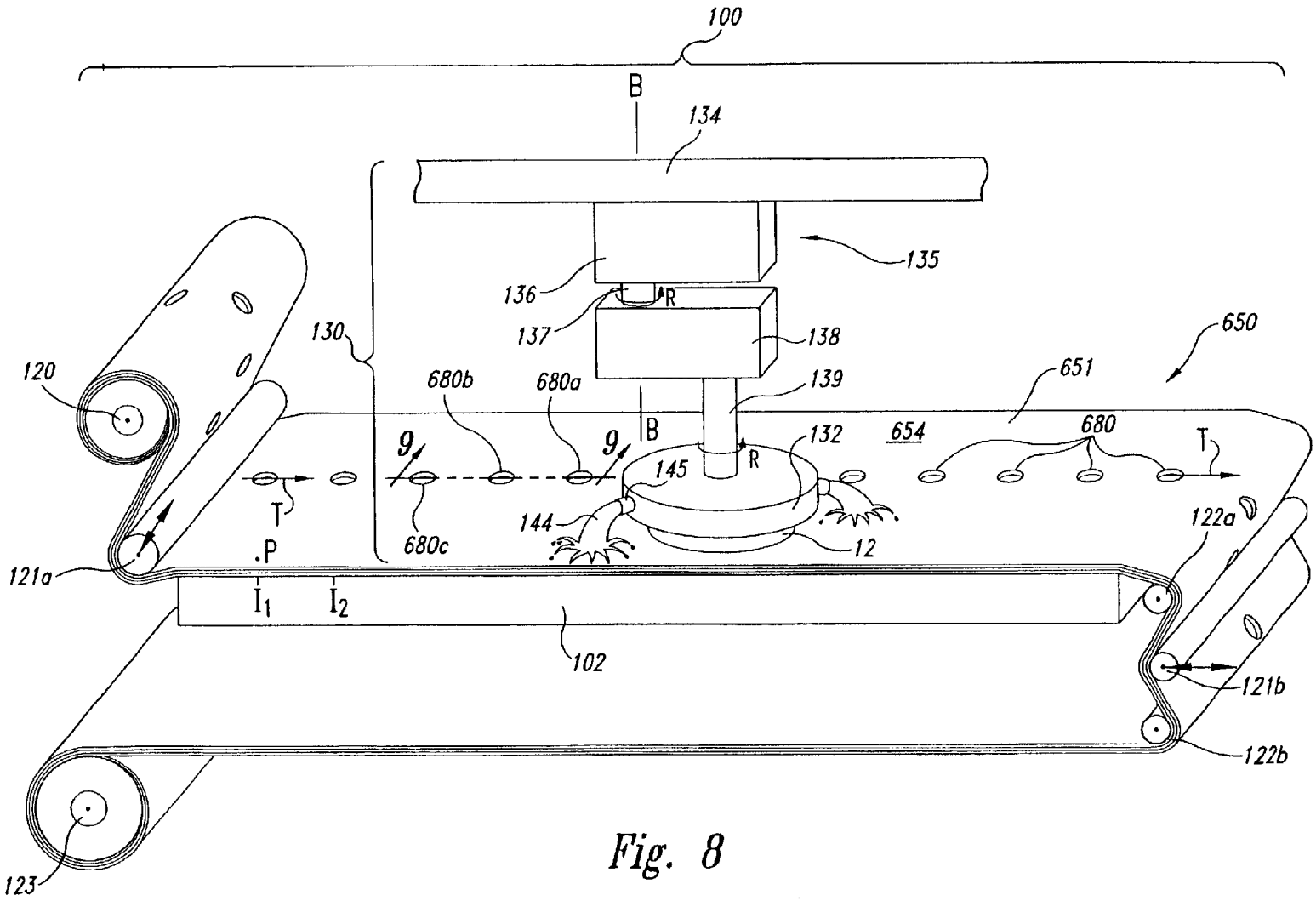
FIG. 8 is an isometric view of a web-format planarizing machine and a web-format polishing pad in accordance with another embodiment of the invention.
Figure 9:
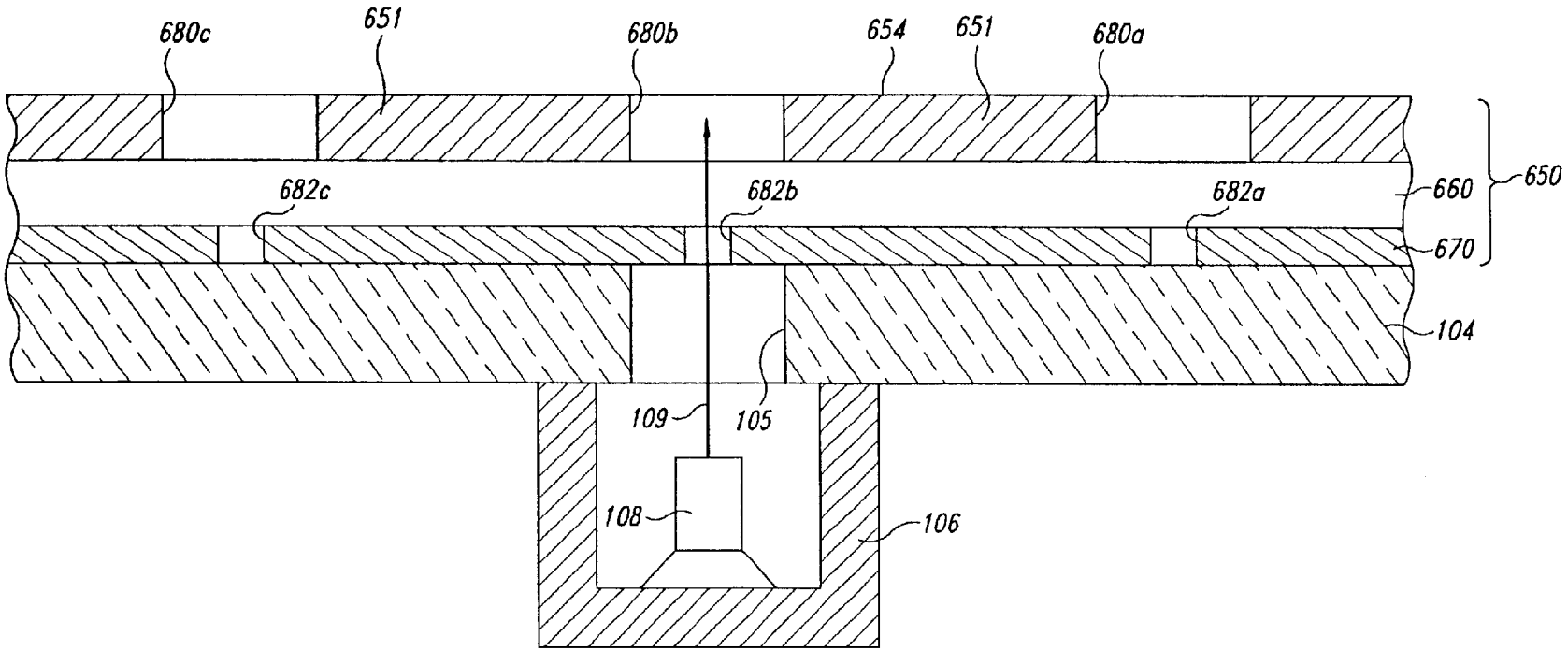
FIG. 9 is a cross-sectional view partially illustrating the planarizing machine and the polishing pad of FIG. 8 taken along line 9—9.

FIG. 8 is an isometric view of the planarizing machine 100 with a polishing pad 650 in accordance with another embodiment of the invention, and FIG. 9 is a cross-sectional view partially illustrating the polishing pad 650 along line 9—9. Referring to FIG. 9, the polishing pad 650 has a planarizing medium 651 with a planarizing surface 654, an optically transmissive backing sheet 660 under the planarizing medium 651, and a compressible backing pad 670 under the optically transmissive backing sheet 660. The polishing pad 650 also has an optical pass-through system including at least one view port 680 in the planarizing medium 651 and at least one view port 682 in the backing pad 670. The optical pass-through system, for example, can include a first plurality of holes 680 through the planarizing medium 651 and a second plurality of orifices 682 through the backing pad 670. The holes 680 and the orifices 682 are arranged in a line extending generally parallel to the pad travel path T—T (FIG. 8). For example, as best shown by FIG. 9, the optical pass-through system of this embodiment includes discrete holes 680*a*–680*c* in the planarizing medium 651 and corresponding discrete orifices 682*a*–682*c* in the backing pad 670. Each orifice 682 in the backing pad 670 is aligned with a corresponding hole 680 in the planarizing medium 651, and each pair of aligned holes 680 and 682 defines a view site of the optical pass-through system for the polishing pad 650. As a result, the light beam 109 can pass through the polishing pad 650 when a view site having a pair of holes 680 and 682 is aligned with the illumination site.

From the foregoing it will be appreciated that, although specific embodiments of the invention have been described herein for purposes of illustration, various modifications may be made without deviating from the spirit and scope of the invention. For example, several embodiments of the invention may also include polishing pads with a circular shape or other shapes for use on rotary polishing machines. Accordingly, the invention is not limited except as by the appended claims.

What is claimed is:

1. A polishing pad for mechanical or chemical-mechanical planarization of microelectronic-device substrate assemblies on a stationary table having a first dimension extending along a pad travel path and an illumination site from which a light beam can emanate from the table, the pad comprising:

a planarizing medium having a planarizing surface configured to engage a substrate assembly and a backside to face towards the table, the planarizing medium being moveable over the table along the pad travel path to place a fresh portion of the planarizing surface at one side of a planarizing zone on the table and to remove a worn portion of the planarizing surface from an opposite side of the planarizing zone; and an optical pass-through system in the planarizing medium, the optical pass-through system having a plurality of view sites extending along a length of the planarizing medium in a direction generally parallel to the pad travel path, each view site providing an optically transmissive path through the pad.

2. The polishing pad of claim 1, further comprising:

an optically transmissive backing sheet having a top surface and a under surface, the planarizing medium being disposed on the top surface;

a backing pad attached to the under surface of the backing sheet; and wherein the optical pass-through system comprises at least one opening in the planarizing medium alignable with the illumination site on the table and at least one orifice in the backing pad at least partially aligned with the opening in the planarizing medium.

3. The polishing pad of claim 1 wherein the optical pass-through system comprises a plurality of holes through the planarizing medium arranged in a line along the length of the planarizing medium in the direction generally parallel to the pad travel path, each hole being separately alignable with the illumination site according to the portion of the pad over the illumination site.

4. The polishing pad of claim 1, further comprising an optically transmissive backing sheet having a top surface and an under surface, the planarizing medium being disposed on the top surface of the backing sheet, and wherein the optical pass-through system comprises a plurality of holes through the planarizing medium arranged in a line along the length of the planarizing medium in the direction generally parallel to the pad travel path, each hole defining a separate view site.

5. The polishing pad of claim 1, further comprising a backing pad having a top surface and an under surface, the planarizing medium being disposed on the top surface of the backing pad, wherein the optical pass-through system comprises a first plurality of holes through the planarizing medium arranged in a line along the length of the planarizing medium in the direction generally parallel to the pad travel path, and the optical pass-through system further comprises a second plurality of holes in which each hole of the second plurality of holes is aligned with a corresponding hole of the first plurality of holes.

6. The polishing pad of claim 1, further comprising an optically transmissive backing sheet having a top surface and an under surface, and wherein the planarizing medium is an abrasive layer having a resin and abrasive particles distributed in the resin, the planarizing medium being disposed on the top surface of the backing sheet.

7. The polishing pad of claim 6 wherein the optical pass-through system comprises a plurality of holes through the planarizing medium arranged in a line along the length of the planarizing medium in the direction generally parallel to the pad travel path, each hole being alignable with the illumination site as the pad incrementally moves over the table.

8. A polishing pad for chemical-mechanical planarization of microelectronic-device substrate assemblies, comprising:

an optically transmissive backing sheet having a top surface and an under surface;

a backing pad attached to the under surface of the backing sheet, the backing pad having at least one viewing port; and a planarizing medium disposed on the top surface of the backing sheet, the planarizing medium having at least one viewing port at least partially aligned with the viewing port in the backing pad.

9. The polishing of claim 8 wherein:

the at least one viewing port in the planarizing medium comprises a plurality of holes through the planarizing medium, the holes being arranged in a line that extends in a direction generally parallel to the pad travel path along a length of the planarizing medium; and the at least one viewing port in the backing pad comprises a slot through the backing pad that extends in the direction generally parallel to the pad travel path in alignment with the plurality of holes.

10. The polishing pad of claim 8 wherein:

the at least one viewing port in the planarizing medium comprises a plurality of holes through the planarizing medium, the holes being arranged in a line that extends in a direction generally parallel to the pad travel path along a length of the planarizing medium; and the at least one viewing port in the backing pad comprises a plurality of orifices through the backing pad, each orifice in the backing pad being aligned with a corresponding hole through the planarizing medium.

11. A polishing pad for chemical-mechanical planarization of microelectronic-device substrate assemblies, comprising:

an optically transmissive backing sheet having a top surface and an under surface; and a planarizing medium disposed on the top surface of the backing sheet, the planarizing medium having at least one viewing port configured to be aligned with the illumination site in the table.

12. The polishing pad of claim 11 wherein the viewing port in the planarizing medium comprises a plurality of holes through the planarizing medium, the holes being arranged in a line that extends in a direction generally parallel to the pad travel path along a length of the planarizing medium.

13. A planarizing machine for mechanical or chemical-mechanical planarization of microelectronic-device substrate assemblies, comprising:

a table including a support surface having a first dimension extending along a pad travel path, a second dimension transverse to the first dimension and a planarizing at zone at least within the first and second dimensions;

a light source under to the table at an illumination site from which a light beam can emanate from the support surface of the table;

a polishing pad moveably coupled to the support surface of the table, the pad including a planarizing medium and an optical pass-through system, wherein the planarizing medium includes a planarizing surface configured to engage a substrate assembly and a backside to face towards the table, and wherein the optical pass-through system includes a plurality of view sites along a length of the pad in a direction generally parallel to the pad travel path, each view site providing an optically transmissive path through the pad;

a pad advancing mechanism engaged with the pad, the advancing mechanism being configured to move the pad over the table along the pad travel path to place a fresh portion of the planarizing surface at one side of a planarizing zone on the table and to remove a worn portion of the planarizing surface from an opposite side of the planarizing zone; and a carrier assembly having a head for holding a substrate assembly and a drive assembly connected to the head to move the substrate assembly with respect to the polishing pad.

14. The polishing pad of claim 13, further comprising:

an optically transmissive backing sheet having a top surface and a under surface, the planarizing medium being disposed on the top surface;

a backing pad attached to the under surface of the backing sheet; and wherein the optical pass-through system comprises at least one opening in the planarizing medium alignable with the illumination site on the table and at least one orifice in the backing pad at least partially aligned with the opening in the planarizing medium.

15. The polishing pad of claim 13 wherein the optical pass-through system comprises a plurality of holes through the planarizing medium arranged in a line along the length of the planarizing medium in the direction generally parallel to the pad travel path, each hole being separately alignable with the illumination site according to the portion of the pad over the illumination site.

16. The polishing pad of claim 13, further comprising an optically transmissive backing sheet having a top surface and an under surface, the planarizing medium being disposed on the top surface of the backing sheet, and wherein the optical pass-through system comprises a plurality of holes through the planarizing medium arranged in a line along the length of the planarizing medium in the direction generally parallel to the pad travel path, each hole defining a separate view site.

17. The polishing pad of claim 13, further comprising an optically transmissive backing sheet having a top surface and an under surface, and wherein the planarizing medium is an abrasive layer having a resin and abrasive particles distributed in the resin, the planarizing medium being disposed on the top surface of the backing sheet.

18. The polishing pad of claim 17 wherein the optical pass-through system comprises an elongated slot through the planarizing medium and extending along the length of the planarizing medium in the direction generally parallel to the pad travel path to divide the planarizing medium into a first section and a second section.

19. The polishing pad of claim 17 wherein the optical pass-through system comprises a plurality of holes through the planarizing medium arranged in a line along the length of the planarizing medium in the direction generally parallel to the pad travel path, each hole being alignable with the illumination site as the pad incrementally moves over the table.

20. A planarizing machine for mechanical or chemical-mechanical planarization of microelectronic-device substrate assemblies, comprising:

a table including a support surface having a first dimension extending along a pad travel path, a second dimension transverse to the first dimension and a planarizing at zone at least within the first and second dimensions;

a light source attached to the table at an illumination site from which a light beam can emanate from the support surface of the table;

a polishing pad moveably coupled to the support surface of the table, the pad including an optically transmissive backing sheet having an under surface facing the table and a top surface, the pad also including a planarizing medium disposed on the top surface of the backing sheet, and the planarizing medium having at least one opening configured to be aligned with the illumination site in the table;

a pad advancing mechanism engaged with the pad, the advancing mechanism configured to move the pad over the table along the pad travel path to place a fresh portion of the planarizing surface at one end of a planarizing zone on the table and to remove a worn portion of the planarizing surface from an opposite end of the planarizing zone; and a carrier assembly having a head for holding a substrate assembly and a drive assembly connected to the head to move the substrate assembly with respect to the polishing pad.

* * * * *

UNITED STATES PATENT AND TRADEMARK OFFICE

CERTIFICATE OF CORRECTION

PATENT NO. : 6,932,672 B2
APPLICATION NO. : 09/833029
DATED : August 23, 2005
INVENTOR(S) : Jason B. Elledge It is certified that error appears in the above-identified patent and that said Letters Patent is hereby corrected as shown below:

| Column, Line | Reads | Should Read |
|---|---|---|
| Column 5, Line 4 | "interferrometer" | --interferometer-- |
| Column 7, Line 32 | "system in defined" | --system is defined-- |
| Column 8, Line 30 | "and a under surface," | --and an under surface,-- |
| Column 9, Lines 63-64 | "a planarizing at zone" | --a planarizing zone-- |
| Column 9, Line 65 | "a light source under to the table" | --a light source under the table-- |
| Column 10, Line 24 | "and a under surface," | --and an under surface,-- |
| Column 11, Lines 6-7 | "a planarizing at zone at least within" | --a planarizing zone at least within-- |

Signed and Sealed this

Twelfth Day of June, 2007

JON W. DUDAS
*Director of the United States Patent and Trademark Office*